United States Patent [19]

Ogura

[11] Patent Number: 4,924,268

[45] Date of Patent: May 8, 1990

[54] ELECTRONIC COPIER WITH SIMULTANEOUS CHARGER AND ERASING ARRAY CLEANING

[75] Inventor: Masahiko Ogura, Yokohama, Japan

[73] Assignee: Kabushiki Kaisha Toshiba, Kawasaki, Japan

[21] Appl. No.: 278,111

[22] Filed: Nov. 30, 1988

[30] Foreign Application Priority Data

Nov. 30, 1987 [JP] Japan ..... 62-302028

[51] Int. Cl.[5] ..... G03G 21/00; G03G 15/02

[52] U.S. Cl. ..... 355/219; 355/205; 355/218; 355/221

[58] Field of Search ..... 355/204, 205, 208, 218, 355/219, 221, 297

[56] References Cited

FOREIGN PATENT DOCUMENTS

| | | | |
|---|---|---|---|
| 62-91976 | 4/1987 | Japan | 355/221 |
| 63-98673 | 4/1988 | Japan | 355/221 |
| 63-153574 | 6/1988 | Japan | 355/218 |

*Primary Examiner*—A. T. Grimley
*Assistant Examiner*—E. Pipala
*Attorney, Agent, or Firm*—Foley & Lardner, Schwartz, Jeffery, Schwaab, Mack, Blumenthal & Evans

[57] ABSTRACT

An electronic copier including a corona charger having a charging wire for uniformly charging the surface of a photoconductor and a shield case for receiving the charging wire; a charge eliminator for emitting light onto a non-image area of the photoconductor to remove charges from the non-image area; a cleaning unit having cleaning members for simultaneously wiping the charging wire and the light emitting faces of the charge eliminator; a driving motor for moving the cleaning members; and a microcomputer control portion for counting and cumulating the number of copies of every copying operation, and activating the driving motor to operate the cleaning members as well as resetting the counted and cumulated number of copies to zero, if the counted and cumulated number of copies is equal to or larger than a predetermined value after the completion of each series of copying operation.

11 Claims, 6 Drawing Sheets

ELECTRONIC COPIER WITH SIMULTANEOUS CHARGER AND ERASING ARRAY CLEANING

BACKGROUND OF THE INVENTION

1. Field of the Invention

The present invention relates to an electronic copier, and particularly to a cleaning unit of the copier for cleaning a charger for charging a photoconductor and a charge eliminator for eliminating charges from the photoconductor. More particularly, the present invention relates a cleaning unit that can maintain the quality of copier and reduce the useless consumption of toner.

2. Description of the Prior Art

In a standard electronic copier, a photoconductor is disposed around a photoconductor drum and uniformly charged with a charger. Charges at a non-image area of the photoconductor are eliminated by a charge eliminator. Then,the photoconductor is exposed by an exposure unit to form an electrostatic latent image corresponding to an original image on the photoconductor. The latent image is applied with toner to form a toner image, which is transferred onto a sheet of paper. The sheet is heated by a heater to fix the toner image on the sheet.

A charging wire of the charger for uniformly charging the photoconductor and the light emitting faces of a LED array (a charge eliminating lamp array) of the charge eliminator for removing charges from the non-image area of the photoconductor tend to stain with toner and paper dusts during the use. If they are stained, the photoconductor may not be charged uniformly to cause unevenness in an image to be formed, and the charge eliminator may insufficiently eliminate charges from the non-image area to uselessly increase the consumption of toner.

Conventionally, the electronic copier is periodically inspected by a serviceman, who disassembles the copier and cleans the charging wire of the charger and the LED array of the charge eliminator. However, such as cleaning work is not sufficient. To cope with this problem, there have been proposed various cleaning units for automatically cleaning the charger and charge eliminator. A typical cleaning unit comprises cleaning members for cleaning the charger and charge eliminator and a driving source of the cleaning members. The cleaning unit is operated during a warm-up period just after the energization of the copier.

Namely, the conventional cleaning unit cleans the charger and charge eliminator of the electronic copier only in the warm-up period just after the start of the copier. Since high-speed copiers have been developed to increase the frequency of use of the copiers, the copiers tend to be kept in an ON state for a long time. Therefore, a large number of copies are taken until the copiers are turned off, thus staining charging wires and the light emitting faces of LED arrays of the copiers. As a result, the quality of copies is deteriorated, and the useless consumption of toner is increased.

SUMMARY OF THE INVENTION

An object of the present invention is to provide an electronic copier which can maintain the quality of copies and reduce the useless consumption of toner.

Another object of the present invention is to provide an electronic copier which can clean its charger and charge eliminator according to the number of copies taken by the copier.

In order to accomplish the objects, the present invention provides an electronic copier which comprises a corona charger having a charging wire for uniformly charging the surface of a photoconductor and a shield case for receiving the charging wire; a charge eliminator for emitting light onto a non-image area of the photoconductor to remove charges from the non-image area; a cleaning unit having cleaning members for simultaneously wiping the charging wire and the light emitting faces of the charge eliminator; a driving source for moving the cleaning members; a counter for counting and cumulating the number of copies of every copying operation; a resetting device for resetting the counter; and a device for activating the driving source to operate the cleaning members as well as activating the resetting device to reset the counter only when the number of copies counted and cumulated by the counter is equal to or larger than a predetermined value after the completion of each series of copying operation.

According to the electronic copier of the present invention, the number of copies counted and cumulated by the counter is compared with the predetermined value after the completion of each series of copying operation, and, if the number is equal to or larger than the predetermined value, the driving source of the cleaning unit is activated to clean the charging wire and the lamps of the charge eliminator. At the same time, the counter for counting and cumulating the number of copies is reset. Then, the counter again counts and cumulates the number of copies of every copying operation to repeat the above-mentioned sequence. As a result, the charger and charge eliminator are cleaned not only at the start of the copier but also at set timings so that the stabilized copying operation may be secured.

These and other objects, features and advantages of the present invention will be more apparent from the following detailed description of preferred embodiments in conjunction with the accompanying drawings.

DETAILED DESCRIPTION OF THE PREFERRED EMBODIMENTS

Figure 1:
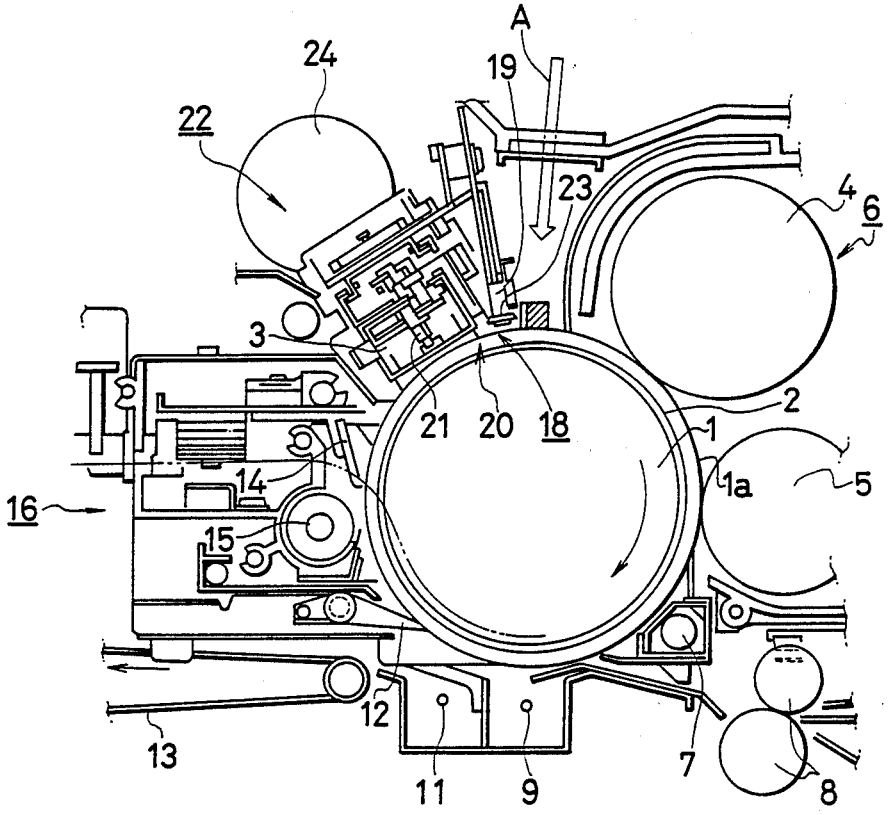
FIG. 1 is a front view showing a photoconductor drum of an electronic copier according to an embodiment of the present invention.

FIG. 1 is a front view showing a photoconductor 1*a* and its periphery of an electronic copier according to an embodiment of the present invention.

The photoconductor 1*a* is disposed on the peripheral surface of a photoconductor drum 1. A drum heater 2 is arranged in the vicinity of the peripheral surface of the photoconductor drum 1 to keep the photoconductor drum 1 warm. The drum 1 is rotated in the direction of an arrow mark shown in the figure, and the surface of the photoconductor 1*a* is uniformly charged with a charger 3 of a charging unit 22. A drum thermistor 2*a* detects a surface temperature of the photoconductor drum 1 to control the drum heater 2 such that the temperature of the drum 1 is maintained at a fixed value.

As exposure unit (not shown) comprising exposure lamps and optical system including lenses and mirrors scans an original image. The scanned image is guided as indicated with an arrow mark A shown in FIG. 1 to form an electronic latent image on the photoconductor 1*a*. The latent image is developed by a developing unit 6 including an upper magnet roller 4, a lower magnet roller 5, etc., to form a toner image on the photoconductor 1*a*. Charges at non-image portions except the toner image portion are eliminated by a charge eliminator lamp 7 before the toner image is transferred to a recording medium.

A pair of resist rollers 8 transport a sheet of paper to the surface of the photoconductor drum 1, and a transfer charger 9 transfers the toner image onto the sheet of paper, which is removed from the photoconductor drum 1 by a removing charger 11 and a remover 12. The removed sheet is transported by a transporting belt 13 to a fixing unit, in which the toner image is fixed on the sheet.

After the transfer of the toner image to the sheet, toner remaining on the photoconductor 1*a* is cleaned by a drum cleaning unit 16 having a cleaning blade 14 and a toner discharging auger 15. Then, the photoconductor 1*a* is again charged with the charger 3.

On the down stream side (the right-hand side in FIG. 1), there is disposed a LED array 19 of a charge eliminator 18 which emits light onto a non-image area of the photoconductor 1*a* to eliminate charges from the non-image area, thereby reducing the useless consumption of toner.

The charging unit 22 is provided with cleaning members 21 for cleaning a charging wire 31 (FIG. 2) of the charger 3, while the charge eliminator 18 is provided with a cleaning member 23 for cleaning the light emitting faces of the LED array 19. A motor 24 for moving the cleaning members 21 and 23 is disposed on the back of the charging unit 22.

Figure 2:
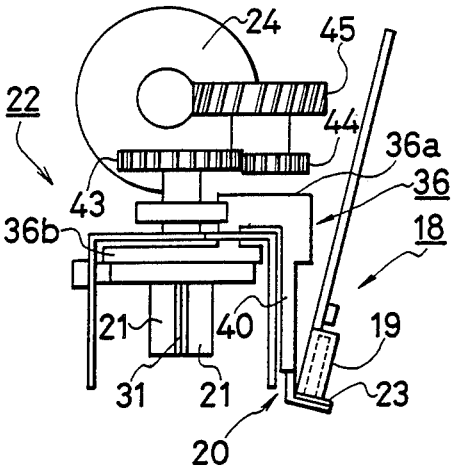
FIG. 2 is a front view showing a charger and a charge eliminator of the copier according to the embodiment of the present invention.
Figure 3:
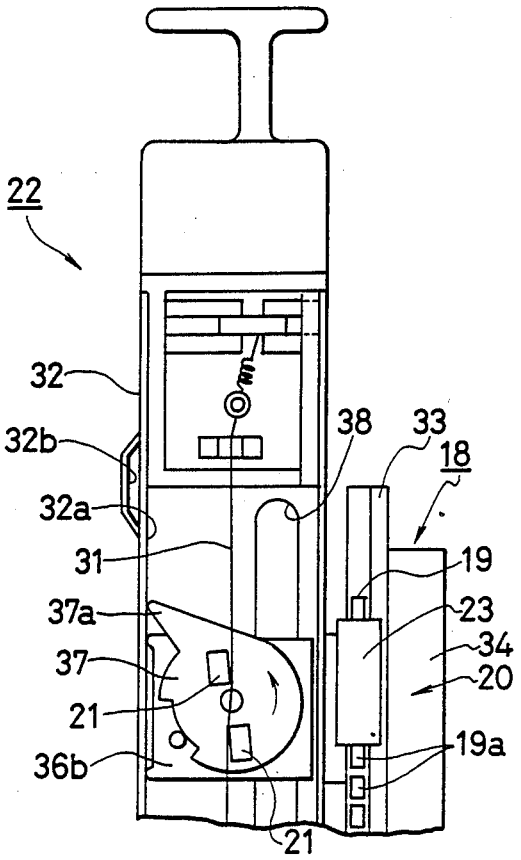
FIG. 3 is a back view showing the charger and charge eliminator shown in FIG. 2.
Figure 4:
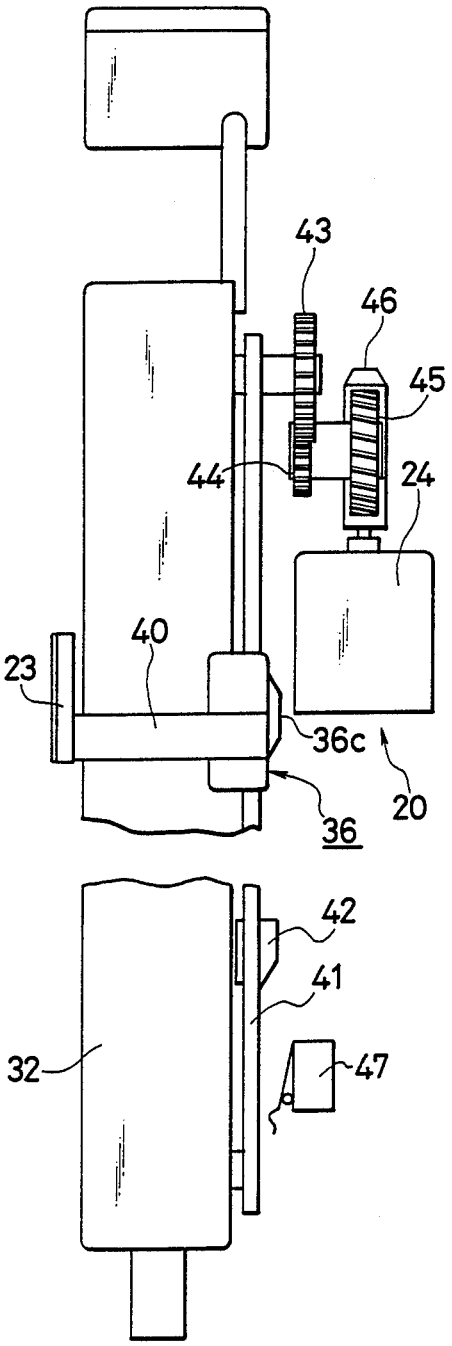
FIG. 4 is a side view showing the charger and charge eliminator shown in FIG. 2.
Figure 5:
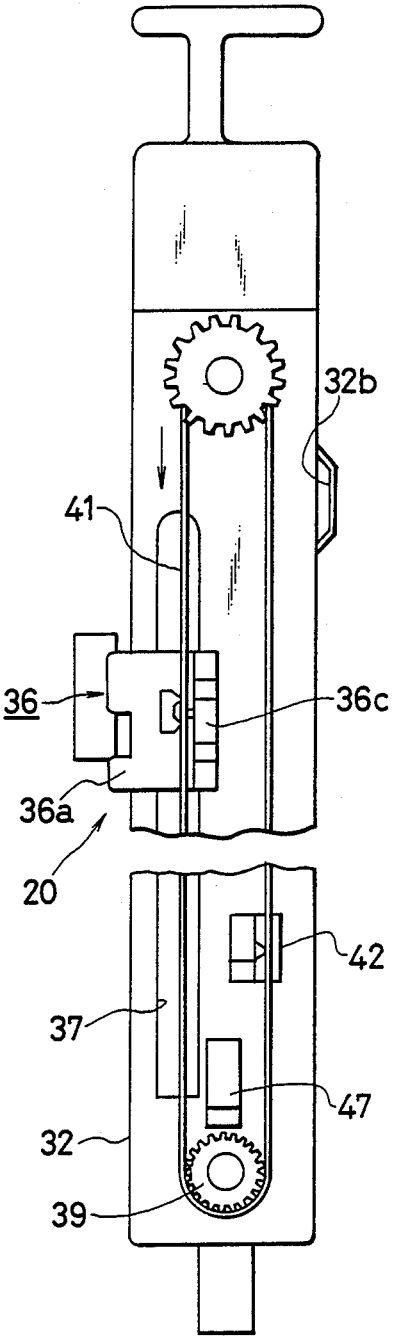
FIG. 5 is a plan view showing the charger and charge eliminator shown in FIG. 2.

FIG. 2 is a front view showing the charging unit 22 and charge eliminator 18, FIG. 3 a back view of the same, FIG. 4 a side view of the same, and FIG. 5 a plan view of the same.

In FIGS. 2 to 5, the top and both sides of the charging wire 31 of the charging unit 22 is surrounded by a shield case 32. Both ends of the charging wire 31 are fitted to proper positions of the shield case 32. The LED array 19 of the charge eliminator 18 comprises a plurality of LEDs 19*a* that are arranged in a cover 33 and soldered to a printed board 34 incorporating a circuit for turning on and off the LEDs 19*a*.

A cleaning unit 20 for cleaning the charging wire 31 and the light emitting faces of the LED array 19 will be explained.

The cleaning unit 20 has a holder 36 for movably holding the cleaning members 21 and 23. The holder 36 comprises a upper plate 36*a* extending above the shield case 32 and a lower plate 36*b* received in the shield case 32. The lower plate 35*b* is solidly connected with the upper plate 36*a* through a connecting member which passes through a long hole 38 formed on the shield case 32. The lower plate 36*b* is provided with a support plate 37 which is pushed in the direction of an arrow mark shown in FIG. 3. An arm 37*a* formed on the periphery of the support plate 37 contacts with an inner wall 32*a* of the shield case 32. The support plate 37 has a pair of the cleaning members 21 which removably contact with the charging wire 31.

As shown in FIG. 5, a pair of timing pulleys 39 are arranged on the shield case 32. A timing belt 41 is stretched around the timing pulleys 39. To a proper position of the timing belt 41, the holder 36 is fixed. Further, an actuator 42 is fixed to the timing belt 41. A gear 43 integral with one of the timing pulleys 39 is connected to a worm 46 of the motor 24 via a gear 44 and a worm gear 45 which is integral with the gear 44. Therefore, by driving the motor 24, the timing belt 41 is rotated to move the holder 36 along the long hole 38.

On the shield case 32, a detection switch 47 for detecting the position of the cleaning members 21 is arranged. The detection switch 47 is operated by the actuator 42 fixed to the timing belt 41 when the cleaning members 21 are at home positions (on this side of FIG. 2 and on the upper sides of FIGS. 3 to 5), and operated by a projection 36c of the holder 36 when the cleaning members 21 move opposite to the home positions (FIG. 4).

The cleaning members 21 usually stay at the home positions where the arm 37*a* of the support plate 37 is in a recess 32*b* of the inner wall 32*a* of the shield case 32 so that the support plate 37 may have been turned in the direction of an arrow mark of FIG. 3 to separate the cleaning members 21 from the charging wire 31.

Figure 6:
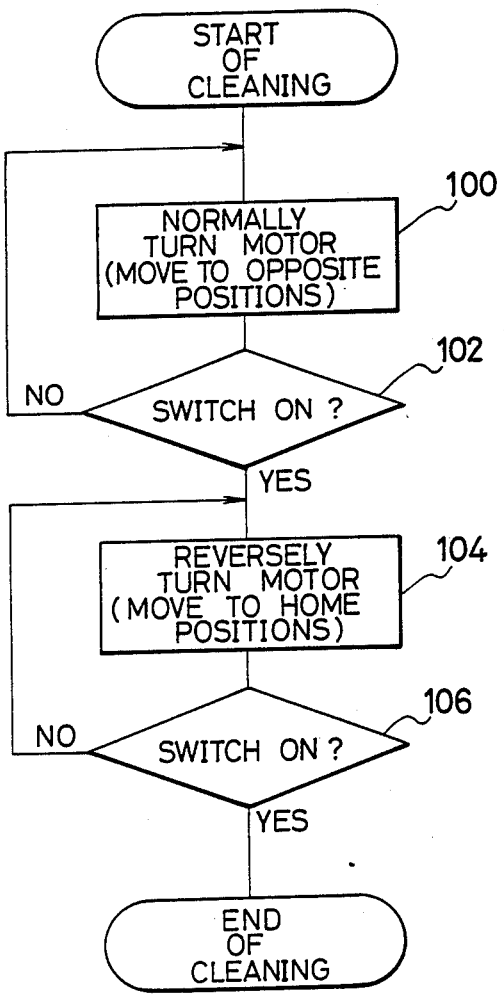
FIG. 6 is a flowchart showing the sequence of cleaning operation according to the present invention.

FIG. 6 is a flowchart showing the sequence of cleaning operation.

In the electronic copier adopting the cleaning unit 20 of the present invention, the charging wire 31 is firstly cleaned just after a power source of the copier is turned on. Namely, the motor 24 normally turns when the power source of the copier is turned on, to move the timing belt 41 in the direction of an arrow mark shown in FIG. 5 (step 100). Accordingly, the holder 36 moves also in the direction of the arrow mark shown in FIG. 5. The arm 37*a* of the support plate 37 comes out of the recess 32*b* to turn the support plate 37 so that the cleaning members 21 may contact with the charging wire 31 and move opposite to the home positions to clean the charging wire 31. At the same time, the cleaning member 23 of the holder 36 (FIG. 2) moves together with the cleaning members 21 to clean the light emitting faces of the LED array 19.

In step 102, the detection switch 47 detects the projection 36*c* of the holder 36 to reversely turn the motor 24 to move the cleaning members 21 and 23 to the home positions while cleaning the charging wire 31 and LED array 19 (step 104). Then, in step 106, the detection switch 47 detects the actuator 42 fixed to the timing belt 41 to stop the motor 24 and finish the cleaning operation.

Figure 7:
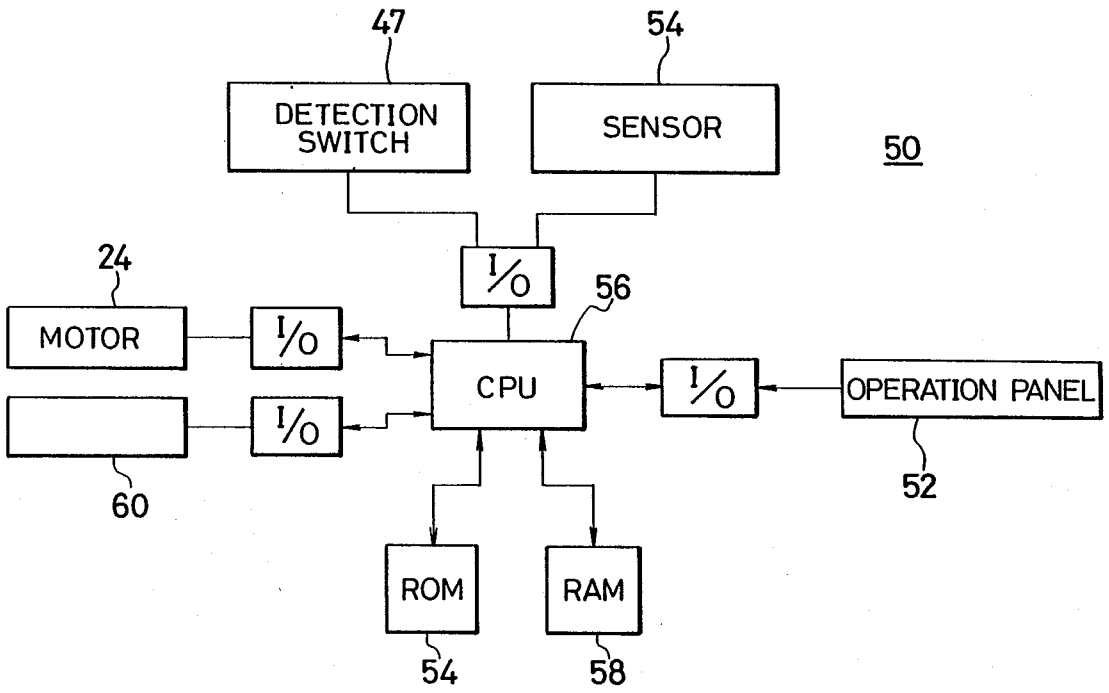
FIG. 7 is a block diagram showing a control circuit for controlling a cleaning unit according to the present invention.

FIG. 7 shows a control circuit 50 for controlling the cleaning unit 20, etc.

In this embodiment, the control of the cleaning motor 24 as well as the control of the whole copier are carried out by a microcomputer having a CPU, a RAM and a ROM.

The control circuit 50 comprises an operation panel 52 for inputting various instructions, a ROM 54 for storing control programs for controlling the copier including the cleaning motor 24, and a CPU 56. The CPU 56 receives an instruction signal from the operation panel 52 and status signals from sensors 54 arranged at various positions of the copier, and outputs control signals to various portions 60 of the copier according to the control programs stored in the ROM 54. The CPU 56 is provided with a RAM 58 for storing operation results, etc. The CPU 56 is connected to the detection switch 47 for detecting a position of the holder 36 and the cleaning motor 24 for moving the holder 36.

Figure 8:
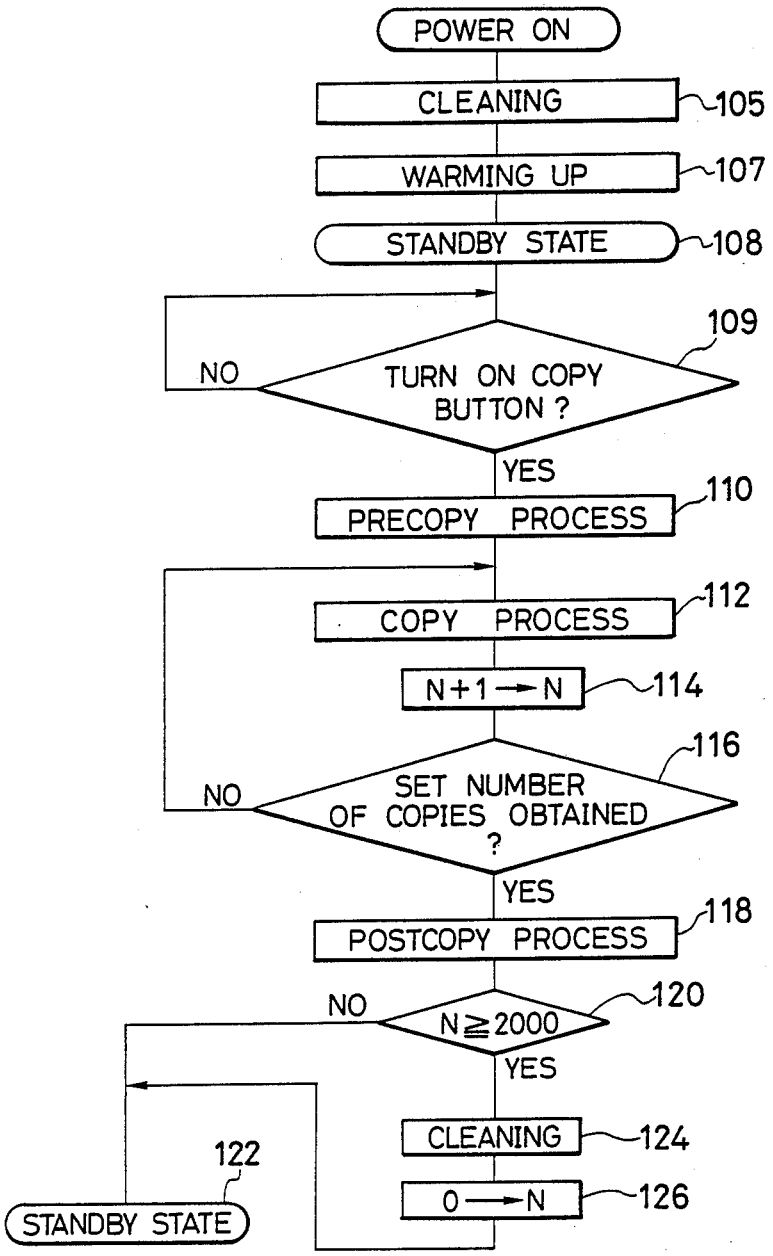
FIG. 8 is a flowchart showing the control sequence of the cleaning unit of the present invention.

FIG. 8 is a flowchart showing the control sequence of the cleaning unit 20.

When the power source of the copier is turned on, the CPU 56 outputs a control signal according to the control programs to normally drive the cleaning motor 24. As a result, the timing belt 41 and holder 36 move to clean the charging wire 31 and LED array 19, and a cumulative copy number N is reset to zero (step 105).

In step 107, a warming up process, in which the photoconductor drum 1 is heated to a predetermined temperature and a fixing heater (not shown) heated to a predetermined temperature, is carried out and a stand by state is achieved (step 108). In step 109, whether or not a copy start button is pushed is judged.

Then, an operator may set the number of copies to be made and pushes a copy start button, which causes the CPU 56 to output a control signal to carry out a precopy process (step 110). In this precopy process, the charging and exposure unit are prepared.

In step 112, a copying process is carried out. In this process, the photoconductor drum 1 is rotated, and the photoconductor 1*a* is uniformly charged by the charger 3. Charges at a non-image area of the photoconductor 1*a* are locally eliminated by the charge eliminator 18. An original image is scanned by the exposure unit (not shown) to form an electrostatic latent image on the photoconductor 1*a*. The latent image is developed by the developing unit 6 and transferred to a sheet of paper. Toner remaining on the photoconductor 1*a* is cleaned by the drum cleaning unit 16. Then, the photoconductor 1*a* is again charged by the charger 3.

In step 114, the CPU 56 increases the cumulative copy number N by one for each copy. IN step 116, it is judged whether or not the copy number set by the operator has been obtained. If not, the steps 112 and 114 are repeated.

If the copy number set by the operator is obtained, a postcopy process is carried out in step 118. In this postcopy process, the copier is returned to an initial state just before the copying process.

After the postcopy process, the CPU 56 judges whether or not the cumulative copy number N is equal to or above a predetermined value, for example 2,000, in step 120. If the cumulative copy number N is less than 2,000, the CPU 56 puts the copier in a standby state in step 122. If the cumulative copy number N is equal to or above 2,000, the CPU 56 activates the cleaning motor 24 to clean the charging wire 31 and LED array 19, and resets the cumulative copy number N to zero in steps 124 and 126. Then, the CPU 56 puts the copier in the standby state in step 122.

According to this embodiment, the charging wire 31 and LED array 19 are automatically cleaned at the start of the copier as well as at the time when the cumulative copy number N exceeds 2,000.

In summary, according to the present invention, a charging wire and a LED array of an electronic copier are automatically cleaned when a cumulative number of copies reaches a predetermined figure, for example 2,000, so that the quality of copies may be maintained and the useless consumption of toner reduced, because the charging wire and LED array are not stained.

Various modifications will become possible for those skilled in the art after receiving the teachings of the present disclosure without departing from the scope thereof.

What is claimed is:

1. An image forming apparatus which scans the surface of a charged photoconductor with light to form a latent image on the photoconductor and develops the latent image, said image forming apparatus comprising;

(a) charging means for uniformly charging the surface of the photoconductor;

(b) charge eliminating means for eliminating charges from an area other than the latent image of the surface of the photoconductor charged by said charging means;

(c) cleaning means for cleaning said charging means and charge eliminating means simultaneously; and (d) control means for counting the number of image formations to control said cleaning means such that said cleaning means cleans said charging means and charge eliminating means when the counted number of image formations is equal to or larger than a predetermined value.

2. The image forming apparatus as claimed in claim 1, wherein said control means resets the counted and cumulated number of image formations to zero after the cleaning of said charging means and charge eliminating means.

3. The image forming apparatus as claimed in claim 1, wherein said control means controls said cleaning means such that said cleaning means cleans said charging means and charge eliminating means when a power source of said image forming apparatus is turned on.

4. The image forming apparatus as claimed in claim 2, wherein said charging means comprises a corona charger having a charging wire for substantially uniformly charging the surface of the photoconductor and a shield case for housing the charging wire.

5. The image forming apparatus as claimed in claim 4, wherein said charge eliminating means comprises a charge eliminator emitting light onto the area other than the latent image of the surface of the photoconductor to eliminate charges from the area.

6. The image forming apparatus as claimed in claim 5, wherein said cleaning means comprises cleaning members to be moved simultaneously to wipe the charging wire and the light emitting faces of the charge eliminator, and a driving unit for moving the cleaning members.

7. The image forming apparatus as claimed in claim 5, wherein said charge eliminator comprises a LED array.

8. The image forming apparatus as claimed in claim 7, wherein the LED array is positioned so as to eliminate charges from the area other than the latent image of the photoconductor charged by the charging wire before the scanning of the light.

9. The image forming apparatus as claimed in claim 8, further comprising developing means for developing the electronic latent image formed by the scanning of the light.

10. An electronic copier which charges the surface of a photoconductor, eliminates charges from an area outside of a recording area on the surface of the charged photoconductor, scans an image area of the surface of the charged photoconductor with light from an original image to form an electrostatic latent image on the photoconductor, develops the latent image to form a toner image on the photoconductor and transfers the toner image onto the recording medium, said electronic copier comprising:

(a) a corona charger having a charging wire for uniformly charging the surface of the photoconductor and a shield case for housing the charging wire;

(b) a charge eliminator emitting light onto the area outside of the recording area on the surface of the photoconductor to eliminate charges from the area outside of the recording area;

(c) cleaning members to be moved to simultaneously wipe the charging wire of said corona charger and the light emitting faces of said charge eliminator;

(d) driving unit for moving said cleaning members;

(e) counting means for counting the number of copies of every copying operation;

(f) resetting means for resetting said counting means;

(g) control means for controlling said driving unit to move said cleaning members as well as controlling said resetting means to reset said counting means to zero, if the counted number of copies is equal to or larger than a predetermined value after the completion of each series of copying operation.

11. The electronic copier as claimed in claim 10, wherein said control means comprises a microcomputer having a CPU, a RAM and a ROM.

* * * * *